US010385833B2

(12) United States Patent
Norberg et al.

(10) Patent No.: US 10,385,833 B2
(45) Date of Patent: Aug. 20, 2019

(54) PISTON PUMP HAVING A STEPPED PISTON

(71) Applicant: Robert Bosch GmbH, Stuttgart (DE)

(72) Inventors: Jens Norberg, Stuttgart (DE); Patrick Schellnegger, Ludwigsburg (DE); Andreas Lechler, Moeglingen (DE); Oliver Gaertner, Abstatt (DE)

(73) Assignee: Robert Bosch GmbH, Stuttgart (DE)

( * ) Notice: Subject to any disclaimer, the term of this patent is extended or adjusted under 35 U.S.C. 154(b) by 83 days.

(21) Appl. No.: 15/512,229

(22) PCT Filed: Sep. 9, 2015

(86) PCT No.: PCT/EP2015/070562

§ 371 (c)(1),
(2) Date: Mar. 17, 2017

(87) PCT Pub. No.: WO2016/041821

PCT Pub. Date: Mar. 24, 2016

(65) Prior Publication Data

US 2017/0291586 A1 Oct. 12, 2017

(30) Foreign Application Priority Data

Sep. 19, 2014 (DE) ..... 10 2014 218 915

(51) Int. Cl.
*F04B 5/00* (2006.01)
*F04B 9/04* (2006.01)
(Continued)

(52) U.S. Cl.
CPC ..... *F04B 5/00* (2013.01); *F04B 1/0408* (2013.01); *F04B 9/042* (2013.01); *F04B 11/00* (2013.01); *F04B 53/126* (2013.01); *F04B 53/14* (2013.01)

(58) Field of Classification Search
CPC ..... F04B 53/126; F04B 53/125; F04B 53/12; F04B 1/0408; F04B 9/025; F04B 9/042;
(Continued)

(56) References Cited

U.S. PATENT DOCUMENTS 6,457,956 B1 * 10/2002 Hauser ..... B60T 8/4031 417/470
6,641,232 B1 * 11/2003 Alaze ..... B60T 8/4031 303/116.4

FOREIGN PATENT DOCUMENTS

DE 41 02 364 A1 7/1992
DE 10 2004 061 810 A1 7/2006
(Continued)

OTHER PUBLICATIONS

International Search Report corresponding to PCT Application No. PCT/EP2015/070562, dated Nov. 26, 2015 (German and English language document) (5 pages).

*Primary Examiner* — Bryan M Lettman
(74) *Attorney, Agent, or Firm* — Maginot, Moore & Beck LLP

(57) ABSTRACT

A reciprocating pump, in particular a hydraulic pump of a slip-controlled vehicle braking system, includes a step piston, a differential pressure valve, and a pump outlet. The step piston includes a piston step that delimits a stepped space which is in communication with the pump outlet via the differential pressure valve. The piston step is configured such that the step space undergoes suction and displacement in a direction opposite to a displacement space, and in smaller quantities than suction and displacement in the displacement space, such that brake fluid volume flow in the pump outlet is evened out, and such that pressure pulsations are inhibited.

3 Claims, 1 Drawing Sheet

(51) Int. Cl.

| | |
|---|---|
| ***F04B 53/12*** | (2006.01) |
| ***F04B 1/04*** | (2006.01) |
| ***F04B 11/00*** | (2006.01) |
| ***F04B 53/14*** | (2006.01) |

(58) Field of Classification Search
CPC .. F04B 1/14; F04B 5/00; F04B 1/0443; F04B 25/02; F04B 5/02
See application file for complete search history.

(56) References Cited

FOREIGN PATENT DOCUMENTS

| | | | |
|---|---|---|---|
| DE | 10 2006 061 462 | B4 | 11/2015 |
| EP | 0 945 614 | A2 | 9/1999 |
| GB | 2 180 302 | A | 3/1987 |
| JP | 11-324901 | A | 11/1999 |
| WO | 2012/084297 | A1 | 6/2012 |

* cited by examiner

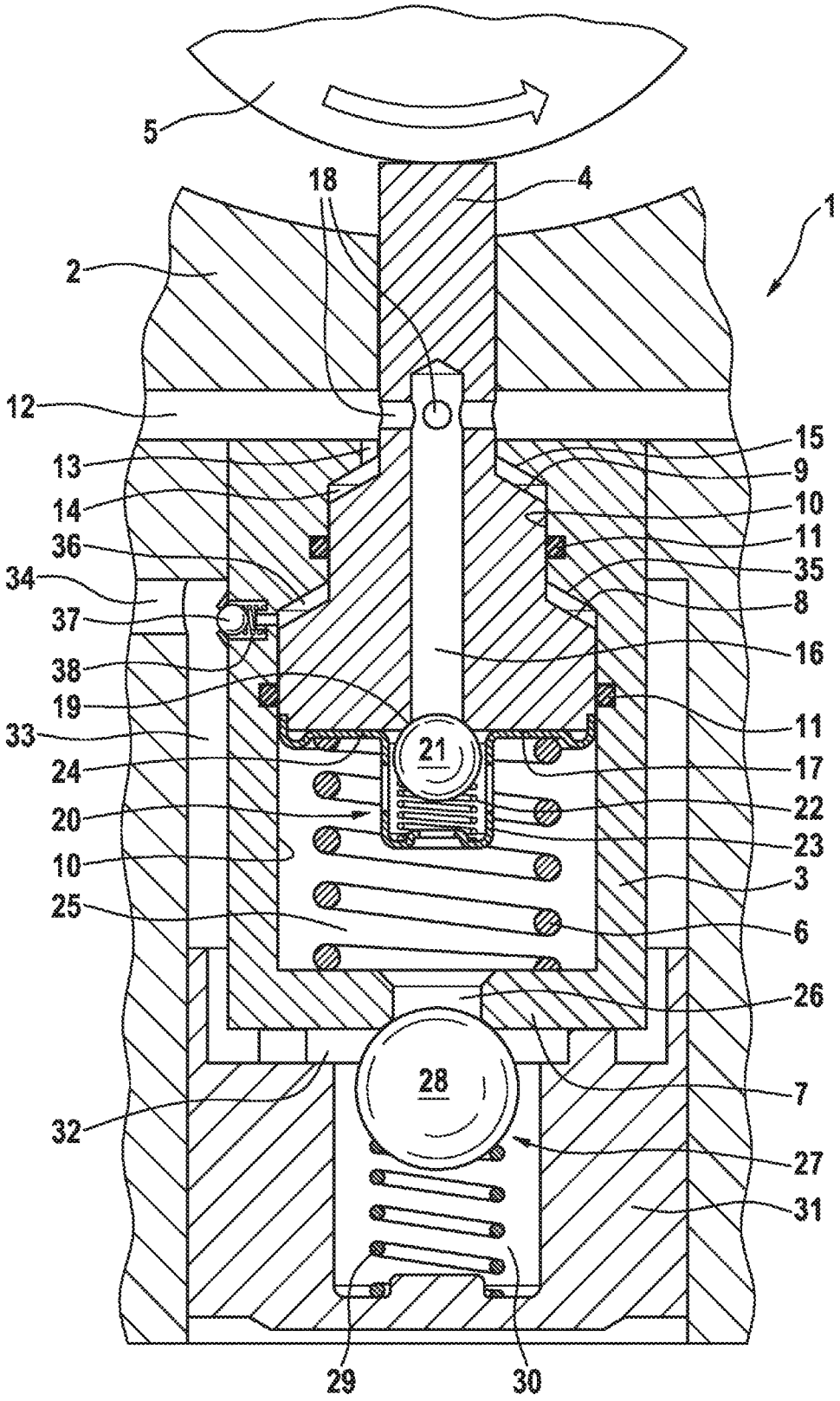
5
18
4
1
2
12
15
13
9
14
10
36
11
34
35
37
8
38
16
19
11
33
21
24
17
20
22
10
23
3
25
6
26
28
7
32
27
31
29
30

PISTON PUMP HAVING A STEPPED PISTON

This application is a 35 U.S.C. § 371 National Stage Application of PCT/EP2015/070562, filed on Sep. 9, 2015, which claims the benefit of priority to Ser. No. DE 10 2014 218 915.2, filed on Sep. 19, 2014 in Germany, the disclosures of which are incorporated herein by reference in their entirety.

The disclosure concerns a piston pump. The piston pump is intended for a slip-controlled, hydraulic, vehicle braking system.

BACKGROUND

Patent application DE 10 2004 061 810 A1 discloses a piston pump with a stepped piston with stepped diameter, which is axially movable inside a pump bore also with stepped diameter. The pump bore need not be produced by boring, but may in principle be produced in any manner. To drive the stepped piston in a reciprocating stroke motion in the pump bore, the known piston pump has a cam which is arranged on an end face of the stepped piston on the cam side, and on the periphery of which an end face of the stepped piston rests. On an end face remote from the cam—which is here designated the displacement side for the sake of clarity—the stepped piston of the known piston pump delimits a displacement chamber in the pump bore, the volume of which alternately reduces and enlarges on a reciprocating stroke movement of the stepped piston. The piston stroke during which the volume of the displacement chamber reduces is here designated the forward stroke, and the stroke in the opposite direction during which the volume of the displacement chamber enlarges is here designated the return stroke. The stepped piston of the known piston pump has a ring step facing away from the displacement chamber and delimiting a chamber in the pump bore, which is here referred to as a step chamber for the sake of clarity. A volume change of the step chamber is the opposite of the volume change of the displacement chamber; the volume of the step chamber enlarges on the forward stroke of the stepped piston and reduces on the return stroke. The step chamber of the known piston pump is an annular chamber surrounding the stepped piston in the pump bore, the cross-section of which is smaller than a cross-section of the displacement chamber, so that the volume change of the step chamber opposite to that of the displacement chamber on the stroke movement of the stepped piston is smaller. The step chamber and the displacement chamber communicate with a pump outlet. On a forward stroke, the stepped piston of the known piston pump displaces fluid from the displacement chamber into the pump outlet, and sucks fluid into the step chamber from the pump outlet. Because the volume change of the displacement chamber is greater than the volume change of the step chamber, on a forward stroke the piston pump displaces fluid from the pump bore into the pump outlet. On the return stroke, the known piston pump sucks in fluid from a pump inlet through an inlet valve into the displacement chamber, the volume of which enlarges on the return stroke, and displaces fluid from the step chamber into the pump outlet. The known piston pump therefore has the advantage that it displaces fluid into the pump outlet on both the forward stroke and on the return stroke, whereby a fluid volume flow in the pump outlet is more even and pressure pulsations are smaller. Ideally, the displacement chamber and the step chamber have cross-section ratios of 2:1, so that the piston pump displaces the same amount of fluid into the pump outlet on both strokes.

SUMMARY

The piston pump according to the disclosure, has a stepped piston with one or more piston steps. The stepped piston is preferably cylindrical with one or more diameter steps, i.e. ring steps, which form one or more piston steps. A cylinder form and ring steps are not however essential for the disclosure. The stepped piston is arranged in a pump bore, also stepped, and can be driven in a reciprocating stroke movement. The pump bore is an inner face of the cylinder, a pump housing, a hydraulic block or similar in which the stepped piston is movably arranged. It may be produced in a manner other than by boring and, like the stepped piston, is preferably but not necessarily cylindrical and has one or more diameter steps.

On one side, here designated the displacement side, the stepped piston delimits a displacement chamber in the pump bore, the volume of which changes on a stroke movement of the stepped piston, depending on the movement direction. At a piston step facing away from the displacement chamber, the stepped piston of the piston pump according to the disclosure delimits a chamber in the pump bore which is here designated the step chamber. On a stroke movement of the stepped piston, the volume of the step chamber changes in a direction opposite to the change in volume of the displacement chamber. While on a stroke of the stepped piston, here designated the forward stroke for the sake of clarity, the volume of the displacement chamber reduces, the volume of the step chamber enlarges. On an opposite stroke of the stepped piston, which is here designated the return stroke, the volume of the displacement chamber enlarges and the volume of the step chamber reduces. A cross-section of the step chamber is smaller than a cross-section of the displacement chamber, so that the volume change of the displacement chamber on a stroke movement of the stepped piston is greater than the opposite volume change of the step chamber. Ideally, the cross-sections of the displacement chamber and the step chamber have a mutual ratio of 2:1.

During a forward stroke, the stepped piston of the piston pump according to the disclosure with its displacement side displaces fluid from the displacement chamber into a pump outlet, and at the same time sucks a smaller quantity of fluid from the pump outlet or the displacement chamber into the step chamber, so that on a forward stroke of its stepped piston, the piston pump as a whole displaces fluid into the pump outlet. On the return stroke, the piston pump sucks fluid out of a pump inlet into the displacement chamber and displaces fluid from the step chamber into the pump outlet, so that the piston pump according to the disclosure also displaces fluid into the pump outlet on a return stroke. With a cross-section ratio of 2:1, the displacement volumes on the forward and reverse strokes are equally large. By the displacement of fluid into the pump outlet on both the forward and the reverse strokes, the piston pump according to the disclosure allows a more even fluid flow in the pump outlet than a conventional piston pump without a pressure-side or outlet-side piston step, and the pressure pulsations are smaller.

According to the disclosure, the piston pump has a valve by means of which the step chamber communicates with the pump outlet. The valve allows the step chamber to be hydraulically separated from the pump outlet in specific operating states. For example, on a high back-pressure in the pump outlet, the valve may close and thus separate the step chamber from the pump outlet hydraulically, so that on a high back-pressure in the pump outlet, the stepped piston does not displace fluid with the piston step but merely with the displacement side.

The claims, detailed description and drawings describe advantageous embodiments and refinements of the disclosure.

An embodiment of the disclosure proposes a check valve for the step chamber which prevents the back-flow of fluid from the pump outlet into the step chamber.

An embodiment of the disclosure proposes a pressure-controlled valve which closes when a pressure in the pump outlet exceeds a closing pressure of the valve. An embodiment of the disclosure provides a differential pressure valve which closes when a pressure difference between the pump outlet and the step chamber exceeds a closing pressure of the differential pressure valve. Both embodiments separate the step chamber hydraulically from the pump outlet on a high back-pressure in the pump outlet, so that the stepped piston does not deliver with the piston step when the back-pressure in the pump outlet is high.

An embodiment of the disclosure concerns the pump piston configured as a stepped piston also on a suction side, so that an intake volume flow of the piston pump according to the disclosure is divided over the forward stroke and the return stroke. This embodiment of the disclosure has the advantage of a more even volume flow and lower pressure pulsations also on the suction side of the piston pump.

BRIEF DESCRIPTION OF THE DRAWINGS

The disclosure is explained in more detail below with reference to an embodiment shown in the drawing. FIG. 1 shows an axial section of a piston pump according to the disclosure. The drawing is a diagrammatic and simplified depiction to explain and assist with comprehension of the disclosure.

DETAILED DESCRIPTION

The piston pump 1 according to the disclosure, shown in the drawing, is provided as a hydraulic pump for a slip-controlled, hydraulic, vehicle braking system, in which such hydraulic pumps are also designated recirculation pumps. It serves to build up pressure, increase pressure and return brake fluid when wheel brake pressures fall during or for traction control or braking. The piston pump 1 is arranged in a hydraulic block 2 which may also be described as a pump housing. The hydraulic block 2 is a cuboid metal block, for example made of aluminum alloy, in which as well as the piston pump 1, further hydraulic components of a slip control system are arranged and connected together hydraulically by means of bores in the hydraulic block. Such further hydraulic components of a slip control system are solenoid valves, check valves, hydraulic accumulators and dampers. Hydraulic blocks for slip control systems are known and not explained further here.

The piston pump 1 has a hollow cylindrical liner 3 which may also be described as a cylinder of the piston pump 1 and accommodates axially movably a cylindrical stepped piston 4 with stepped diameter. A cam 5 which can be driven rotatably is arranged at an end of the stepped piston 4 which protrudes from the liner 3; the rotary axis of said cam runs radially to an axis of the stepped piston 4. A piston spring 6 arranged in the liner 3 rests on a liner floor 7 and presses against an end face of the stepped piston 4 remote from the cam 5, and presses a cam-side end of the stepped piston 4 against the periphery of the cam 5, so that on a rotating drive of the cam 5, the stepped piston 4 is driven in an axially reciprocating stroke movement inside the liner 3.

The stepped piston 4 has two conical diameter steps with which it expands in the direction of the liner floor 7. The diameter steps are here designated piston steps 8, 9. The liner 3 on the inside has a stepped diameter which is complementary to the stepped piston 4, the stepped piston 4 lies between the piston steps 8, 9, and with its largest diameter —i.e. on a side facing away from the cam 5 of the larger piston step 8 remote from the cam 5—lies on the inside on a cylindrical inner face of the liner 3. An inside of the liner 3—which, as stated, may also be designated the cylinder—may also be described as a pump bore 10 irrespective of the manner of its production. Between the piston steps 8, 9 and on the side facing away from the cam 5 of the larger piston step 8 remote from the cam 5, the stepped piston 4 is sealed with sealing rings 11 in the pump bore 10.

Outside the liner 3, the stepped piston 4 of the piston pump 1 is crossed radially by a bore which forms a pump inlet 12 or a suction side of the piston pump 1. Through axially parallel passages 13 on the periphery of the stepped piston 4, the pump inlet 12 communicates with an annular suction chamber 14 of the piston pump 1 which is formed in the liner 3 between a cam-side cylinder step 15 and the cam-side piston step 9.

The stepped piston 4 has an axial blind hole 16 which opens on an end face of the stepped piston 4 remote from the cam 5, here known as the displacement side 17. The axial blind hole 16 is crossed by radial bores 18 through which the blind hole 16 communicates with the pump inlet 12. A check valve is arranged at an opening of the blind hole 16, forming a valve seat 19, as an inlet valve 20 of the piston pump 1. The inlet valve 20 has a ball as a blocking body 21 which is pressed by a valve spring 22 against the valve seat 19. The blocking body 21 and the valve spring 22 are received in a tubular, cylindrical valve cage 23 having a flange 24 which is held by the piston spring 6 on the displacement side 17 of the stepped piston 4. Between the displacement side 17 of the stepped piston 4 and the cylinder floor 7, the piston pump 1 comprises a displacement chamber 25 in the liner 3, the volume of which alternately reduces and enlarges on the reciprocating stroke movement of the stepped piston 4. A movement of the stepped piston 4 away from the cam 5 is here designated the forward stroke which reduces the volume of the displacement chamber 25. An opposite movement of the stepped piston 4 in the direction of the cam 5 is here designated the return stroke and enlarges the volume of the displacement chamber 25. The volume enlargement of the displacement chamber 25 on the return stroke of the stepped piston 4 causes the piston pump 1 to suck brake fluid out of the inlet 12 through the mutually crossing radial bores 18, the axial blind hole 16 and the opening inlet valve 20, into the displacement chamber 25. At the same time, during the return stroke of the stepped piston 4, a volume of the suction chamber 14 reduces, wherein the stepped piston 4 with the cam-side piston step 9 displaces brake fluid from the suction chamber 14 through the passages 13 into the pump inlet 12. This reduces a suction volume through the pump inlet 12 during the return stroke of the pump piston 4. Because a cross-section area of the suction chamber 14 is smaller than a cross-section area of the displacement chamber 25, the volume of brake fluid displaced during the return stroke from the suction chamber 14 into the pump inlet 12 is smaller than the volume of brake fluid sucked into the displacement chamber 25, so that a volume of brake fluid is always sucked in through the pump inlet 12. Ideally, the cross-section areas of the displacement chamber 25 and the suction chamber 14 have a ratio of 2:1, so that on a return stroke of the stepped piston 4, half as much brake fluid is displaced from the suction chamber 14 into the pump inlet 12 as is sucked into the displacement chamber 25.

On the forward stroke of the stepped piston 4, the inlet valve 20 is closed and the volume of the suction chamber enlarges so that the piston pump 1 sucks in brake fluid through the pump inlet 12 also during the forward stroke of the stepped piston 4. If the cross-section ratio of the displacement chamber 25 and the suction chamber 14 is 2:1, the volumes of brake fluid flowing through the pump inlet 12 on the forward stroke and on the return stroke of the stepped piston 4 are equally large. The suction and displacement of brake fluid in the suction chamber 14 causes a suction of brake fluid in the manner explained on both the forward and the return strokes, and consequently a more even intake volume flow and lower pressure pulsations on the suction side of the piston pump 1.

For an outlet, the liner floor 7 comprises a central hole 26, the outer opening of which forms a valve seat of an outlet valve 27 of the piston pump 1. The outlet valve 27 in the embodiment depicted and described is formed as a check valve, in the same way as the inlet valve 20, and has a ball as a blocking body 28 which is pressed by a valve spring 29 from the outside against the opening of the central hole 26 in the liner floor 7 which forms the valve seat. The blocking body 28 and the valve spring 29 are arranged in a blind hole 30 in a pump cover 31 which is pressed or caulked fluid-tightly in the hydraulic block 2. Between the pump cover 30 and the liner floor 7 is a radial gap 32 which transforms into an annular gap 33 surrounding the liner 3, and into which a radial bore opens forming a pump outlet 34, which could also be described as the pressure side of the piston pump 1. On a forward stroke, the stepped piston 4 reduces the volume of the displacement chamber 25 and displaces brake fluid from the displacement chamber 25 through the opening outlet valve 27 into the radial gap 32, from which the brake fluid flows through the annular gap 33 into the pump outlet 34.

Between the piston step 8 remote from the cam and an assigned ring step 35 inside the liner 3, the stepped piston 4 delimits an annular chamber in the liner 3 which is here designated the step chamber 36. A volume of the step chamber 36 enlarges on a forward stroke of the stepped piston 4 while the volume of the displacement chamber 25 reduces, and the volume of the step chamber 36 reduces on a return stroke of the stepped piston 4 while the volume of the displacement chamber 25 enlarges. Because a cross-section area of the annular step chamber 36 is smaller than the cross-section area of the displacement chamber 25, the volume change of the step chamber 36 on a stroke of the stepped piston 4 is smaller than the opposite volume change of the displacement chamber 25. Here again, ideally the cross-section ratio is 2:1 so that the volume changes of the displacement chamber 25 and the step chamber 36 stand in a ratio of 2:1.

The step chamber 36 communicates through a valve 37 with the annular gap 33 surrounding the liner 3, and hence with the pump outlet 34. During a forward stroke of the stepped piston 4, brake fluid is displaced from the displacement chamber 25 into the pump outlet 34, and the piston pump 1 sucks brake fluid out of the annular gap 33 or pump outlet 34 into the step chamber 36. The volume of brake fluid sucked into the step chamber 36 on a forward stroke is smaller than the volume of brake fluid simultaneously displaced from the displacement chamber 25, so that the piston pump 1 as a whole displaces brake fluid into the pump outlet 34.

On a return stroke of the stepped piston 4, the outlet valve 27 is closed and the stepped piston 4 displaces brake fluid from the step chamber 36—which becomes smaller on a return stroke—into the pump outlet 34 so that even on a return stroke, the piston pump 1 displaces brake fluid into the pump outlet 34. Ideally, the quantity of brake fluid displaced from the displacement chamber 25 on a forward stroke of the stepped piston 4 is twice as large as the quantity of brake fluid sucked into the step chamber 36, whereby the total quantity of brake fluid displaced by the piston pump 1 into the pump outlet 34 on a forward stroke and on a return stroke remains the same. Because of the step chamber 36 or the formation of the stepped piston 4 stepped on the outlet side or pressure side, the piston pump 1 has a more even outlet volume flow which is distributed over the forward and the return strokes; pressure pulsations in the pump outlet 34 and hence on the pressure side of the piston pump 1 are reduced.

In the embodiment of the disclosure depicted and described, the valve 37 assigned to the step chamber 36 is a check valve or a differential pressure valve which is held open by a valve spring 38 and which closes when a differential pressure between the pump outlet 34 and the step chamber 36 exceeds a closing pressure of the valve 37. In general, the valve 37 may also be described as a pressure-controlled valve. The closing pressure of the valve 37 is for example 40 bar. If the differential pressure between the pump outlet 34 and the step chamber 36 exceeds the closing pressure of the valve 37, the valve 37 closes and hence separates the step chamber 36 hydraulically from the pump outlet 34. In this way, the piston step 8 of the stepped piston 4 remote from the cam works at maximum against the closing pressure of the valve 37, limiting a force which must be exerted by the piston spring 6 for moving the stepped piston 4 in the return stroke direction.

The invention claimed is:

1. A piston pump, comprising:

a pump outlet;

a valve which is biased to remain open and is configured to be controllable via pressure such that the valve closes in response to a pressure in the pump outlet exceeding a closing pressure of the valve;

a stepped piston that includes a piston step; and a body that includes a stepped piston bore, the stepped piston drivable in a reciprocating stroke movement in the stepped piston bore, and the stepped piston bore having:

a displacement chamber in communication with the pump outlet, the displacement chamber located on a displacement side of the stepped piston, the displacement chamber delimited on one side by the stepped piston, and the displacement chamber configured such that a volume of the displacement chamber reduces as the stepped piston undergoes a forward stroke and enlarges as the stepped piston undergoes a return stroke opposite to the forward stroke; and a step chamber in communication with the pump outlet via the valve, the step chamber located on a side of the piston pump facing away from the displacement chamber, the step chamber having a cross-section that is smaller than a cross-section of the displacement chamber, and the step chamber configured such that a volume of the step chamber enlarges as the stepped piston undergoes the forward stroke and reduces as the stepped piston undergoes the return stroke, wherein the valve is a differential pressure valve that is configured to close in response to a pressure difference between the pump outlet and the step chamber exceeding a closing pressure of the differential pressure valve.

2. The piston pump as claimed in claim 1, wherein the valve is a check valve.

3. The piston pump as claimed in claim 1, wherein the displacement side of the stepped piston and a suction side of the stepped piston are each configured such that the piston pump sucks in fluid from a respective one of the suction side and the displacement side as the stepped piston undergoes a respective one of the forward stroke and the return stroke.

* * * * *